US009138051B2

(12) United States Patent
Pan

(10) Patent No.: US 9,138,051 B2
(45) Date of Patent: Sep. 22, 2015

(54) DESK STRUCTURE WITH ADJUSTABLE ANGLE

(71) Applicant: Toung-Chun Pan, Tainan (TW)

(72) Inventor: Toung-Chun Pan, Tainan (TW)

(73) Assignee: Oasyschair Co., Ltd., Tainan (TW)

( * ) Notice: Subject to any disclaimer, the term of this patent is extended or adjusted under 35 U.S.C. 154(b) by 72 days.

(21) Appl. No.: 14/178,363

(22) Filed: Feb. 12, 2014

(65) Prior Publication Data

US 2015/0223600 A1 Aug. 13, 2015

(51) Int. Cl.

| | |
|---|---|
| ***A47B 7/02*** | (2006.01) |
| ***A47B 41/02*** | (2006.01) |
| ***A47B 13/08*** | (2006.01) |
| ***A47B 3/083*** | (2006.01) |

(52) U.S. Cl.

CPC ..... *A47B 41/02* (2013.01); *A47B 3/083* (2013.01); *A47B 7/02* (2013.01); *A47B 13/081* (2013.01); *A47B 2200/0035* (2013.01)

(58) Field of Classification Search

CPC ..... A47B 3/00; A47B 7/00; A47B 7/02; A47B 27/18; A47B 2003/00; A47B 2009/003; A47B 2200/0035; A47B 2000/0036; A47B 200/0042

See application file for complete search history.

(56) References Cited

U.S. PATENT DOCUMENTS

| | | | | |
|---|---|---|---|---|
| 6,637,352 | B1 * | 10/2003 | Thode et al. | 108/132 |
| 8,291,830 | B2 * | 10/2012 | Rutz | 108/7 |
| 2004/0083932 | A1 * | 5/2004 | Kottman et al. | 108/115 |
| 2005/0252426 | A1 * | 11/2005 | Blasen et al. | 108/91 |
| 2007/0209559 | A1 * | 9/2007 | Mockel | 108/115 |
| 2008/0196635 | A1 * | 8/2008 | Piretti | 108/118 |
| 2009/0114130 | A1 * | 5/2009 | Chirea et al. | 108/124 |
| 2011/0139042 | A1 * | 6/2011 | Korb | 108/115 |
| 2011/0290160 | A1 * | 12/2011 | Williams et al. | 108/124 |
| 2012/0304897 | A1 * | 12/2012 | Williamson et al. | 108/50.11 |
| 2015/0118010 | A1 * | 4/2015 | Krusin et al. | 414/801 |

* cited by examiner

*Primary Examiner* — Daniel Rohrhoff

(74) *Attorney, Agent, or Firm* — Alan D. Kamrath; Kamrath IP Lawfirm, P.A.

(57) ABSTRACT

A desk structure with adjustable angles is provided, characterized in that: an angle-adjustment unit is coupled to a bottom of a desk which is space-demanding and falls into the category of OA office furniture such that folding the desk entails: performing positional release with the angle-adjustment unit disposed below a desk board, rotating the desk board by a predetermined inclination angle, and imposing a positional restriction on the angle-adjustment unit upon completion of the angular positioning of a rotation state. Accordingly, the desks can be folded up each by a predetermined adjustable inclination angle and stacked up in a non-space-demanding direction.

8 Claims, 16 Drawing Sheets

DESK STRUCTURE WITH ADJUSTABLE ANGLE

BACKGROUND OF THE INVENTION

1. Technical Field

The present invention relates to desk structures with adjustable angles, and more particularly, to a desk structure with adjustable angles, characterized in that: the desk structure with adjustable angles is for use with bulky and heavy OA office furniture, such as a desk; an angle-adjustment unit is coupled to the bottom of the desk and disposed beneath a desk board; and folding the desk entails performing positional release with the angle-adjustment unit, rotating the desk board by a predetermined inclination angle, and imposing a positional restriction on the angle-adjustment unit upon completion of the rotation thereof. Accordingly, one or more desks can be folded up each by a predetermined adjustable inclination angle and stacked up in a non-space-demanding direction.

2. Description of Related Art

Conventional desks manufactured by the industrial sector feature desk combinations (such as OA desks, wooden office desks, and desks made of metal) serving a variety of purposes. In this regard, most of the desk combinations must be horizontally mounted in order to work. When users want to stop using the desk combinations, the users have to fold and put the desk legs of one and/or more desks under the desks in a manner that the desks face the same direction in order to save space when stacked up (wherein the desks capable of folding the legs thereof are mostly equipped with a desk board made of lightweight plastics or are compact desks, such as dining tables, tables for use in outdoor worship, and kitchen tables). Alternatively, the desks are not stacked up but are placed at the corners of a room (wherein the aforesaid desk are bulky and heavy desks which fall into the category of OA office furniture). As a result, the prior art is confronted with problems arising from the situation where one and/or more desks have to be stacked up when not in use.

Accordingly, it is imperative to overcome the aforesaid drawbacks of the prior art: OA office furniture, such as desks, poses problems arising from the situation where the desks have to be stacked up when not in use. The present invention aims to overcome the aforesaid drawbacks of the prior art, by performing a simple operation to fold and stack the bulky and heavy desks without taking up much space.

SUMMARY OF THE INVENTION

The present invention aims to overcome a drawback of the prior art—it is inconvenient to fold and store existing bulky and heavy OA office furniture, such as desks. The present invention is characterized in that: an angle-adjustment unit is coupled to a bottom of a desk; and folding the desk by the angle-adjustment unit entails rotating the desk board by a predetermined inclination angle and imposing a positional restriction on the angle-adjustment unit upon completion of the angular positioning of a rotation state. Hence, one and/or more desks can be folded up each by a predetermined adjustable inclination angle and stacked up in a manner to face in the same direction in order to save space.

The first objective of the present invention is described below. A desk structure with adjustable angles is provided, wherein an angle-adjustment unit coupled to a bottom of a desk comprises a desk board, left and right holding frames, two restricting rods, a grip rod, an inverted y-shaped desk legs, two auxiliary connecting elements, and a front guarding panel. The left and right holding frames are disposed on two sides at a bottom of the desk board, respectively, and the restricting rods can be movably inserted into the left and right holding frames, respectively. The left and right holding frames each comprise a carrying unit below and a topping unit above. Frame edges are formed on two sides of predetermined segments of the carrying unit, respectively, and a post extending upward is formed between the segments, to allow the restricting rods to be steadily inserted. Left and right stopping sidewalls are formed on the two sides of the carrying unit, respectively, and a restrictive protruding portion extending forward is protrudingly disposed at the middle segments of the left and right stopping sidewalls, such that a buffer frame for holding the front end of each of the restricting rods is mounted on the carrying unit. Frame edges extend downward from the two sides of the topping unit, respectively, and holes are formed at predetermined positions on the frame edges, such that pins can be passed through the holes of the frame edges when the inverted y-shaped desk legs are inserted and disposed between the frame edges of the topping unit. A slot of a predetermined length is formed at the middle segment of the restricting rods and adapted to admit the post of the carrying unit. A screwing element enclosed by a washer is rotatably screwed to the post, such that the two restricting rods can perform forward and backward displacement between the left and right holding frames and within a predetermined range. An anterior end of each of the restricting rods extends to form an abutting portion, and the abutting portion is appropriately held by the buffer frame disposed laterally at the carrying unit. Each of the restricting rods has another end capable of advancing and retreating movably and adjacent to the abutting portion, and the another end forms an annular portion engageable with a spring, wherein another end of the spring is engageable with one end of the buffer frame, such that the restricting rods are always abutting forward. The posterior end of each of the restricting rods forms a pipe into which a joint ring element and a cover can be inserted, thereby coupling to the grip rod. One upward end of each of the inverted y-shaped desk legs forms a connecting portion, and at least two concave portions are concavely formed at predetermined segments at the periphery of the connecting portion, to timely admit the abutting portions at the ends of the restricting rods. A hole is disposed centrally and penetratingly at the connecting portion, and two curved grooves corresponding in position to the holes are formed within a predetermined range on the connecting portion, such that pins can penetrate the holes and/or the grooves of the connecting portion when the connecting portion is inserted into the topping unit. A C-shaped fastener is disposed at each of the two ends of each said pin to give a positional restriction thereto. Upward ends of the auxiliary connecting elements abut against the bottom of the desk board and are each fastened to corresponding positions on the desk board by a screwing element. A second linking portion is disposed pivotally at each of the downward ends of the auxiliary connecting elements to abut against the back of the front guarding panel, and the auxiliary connecting elements are fastened and fixed to respective positions on the front guarding panel by a screwing element. A bar is pivotally disposed at a predetermined front segment of each of the inverted y-shaped desk legs, and one end of the bar is movably coupled to a third linking portion, so as to abut against a lower portion of the back of the front guarding panel. The bars are fastened and fixed to respective positions on the front guarding panel by a screwing element. Hence, after the angle-adjustment unit has been coupled to the desk board and the front guarding panel, the desk board can be folded up by pulling the grip rod outward by hand to drive the two restricting rods to move outward along with the left and right holding frames, and drive the abutting portions at the front ends of the restricting rods to separate from the concave portions of the connecting portions at the ends of the inverted y-shaped desk legs, such that the desk board can move freely to rotate upward by a predetermined inclination angle. Then, the grip rod is pushed inward to drive the two restricting rods to move forward and allow the abutting portions to be inserted into the concave portions of the connecting portion, respectively, such that the desk board can be folded up when rotated by a predetermined inclination angle, so as to maintain precise positional restriction and allow the one and/or more desks to be tilted and folded and thus stacked up without taking up much space.

The second objective of the present invention is as follows: the buffer frame mounted laterally on the carrying unit comprises a frame and a holding portion, wherein the upper end of the frame extends to form a protruding portion with a hole engageable with one end of the spring, wherein another end of the spring is engageable with an annular portion at one end of each of the restricting rods, and the holding portion of is of an appropriate degree of flexibility and thus can be inserted into the frame, wherein the lower end of the holding portion extends to form a protruding portion with grooves, wherein grooves admit the restrictive protruding portion at a corresponding position on the carrying unit, such that the restricting rods can be inserted steadily into the buffer frame and maintain appropriate resilient displacement.

The third objective of the present invention is as follows: the ends of the auxiliary connecting elements and the second linking portions disposed at the bottom of the desk board are pivotally connected by a pin and/or a screwing element.

The fourth objective of the present invention is as follows: a bar disposed at the front segment of each of inverted y-shaped desk legs and third linking portion are pivotally connected by a pin and/or a screwing element.

The fifth objective of the present invention is as follows: the frame edges disposed on the two sides of the topping unit, into which the connecting portions disposed at the ends of the inverted y-shaped desk legs can be inserted, can be coupled to lateral covers.

The sixth objective of the present invention is as follows: after the restricting rods have been inserted into the left and right holding frames comprising the carrying units and the topping units, the positioning of the restricting rods relative to the left and right holding frames is achieved by a plurality of screwing elements.

The seventh objective of the present invention is as follows: the left and right holding frames are fixed to the two sides of the bottom of the desk board by a plurality of screwing elements penetrating the topping unit and fixed to respective positions on the desk board.

The eighth objective of the present invention is as follows: a stopping block of an appropriate degree of flexibility is coupled to an appropriate space between the concave portions located at a rear portion of the connecting portion at each of the upper ends of the inverted y-shaped desk legs, and a notch is concavely disposed on one side of the carrying unit of each of the left and right holding frames such that, when the desk board is appropriately mounted, the carrying unit straddles the stopping block, and the notch of the carrying unit passes through the stopping block to undergo rotational displacement whenever the desk board needs to be tilted upward and folded, thereby allowing the stacked desk boards to be spaced apart from each other by an appropriate distance when stacked tightly, so as to prevent the surfaces of the desk boards from being scratched.

DETAILED DESCRIPTION OF THE EMBODIMENT OF THE INVENTION

Figure 1:
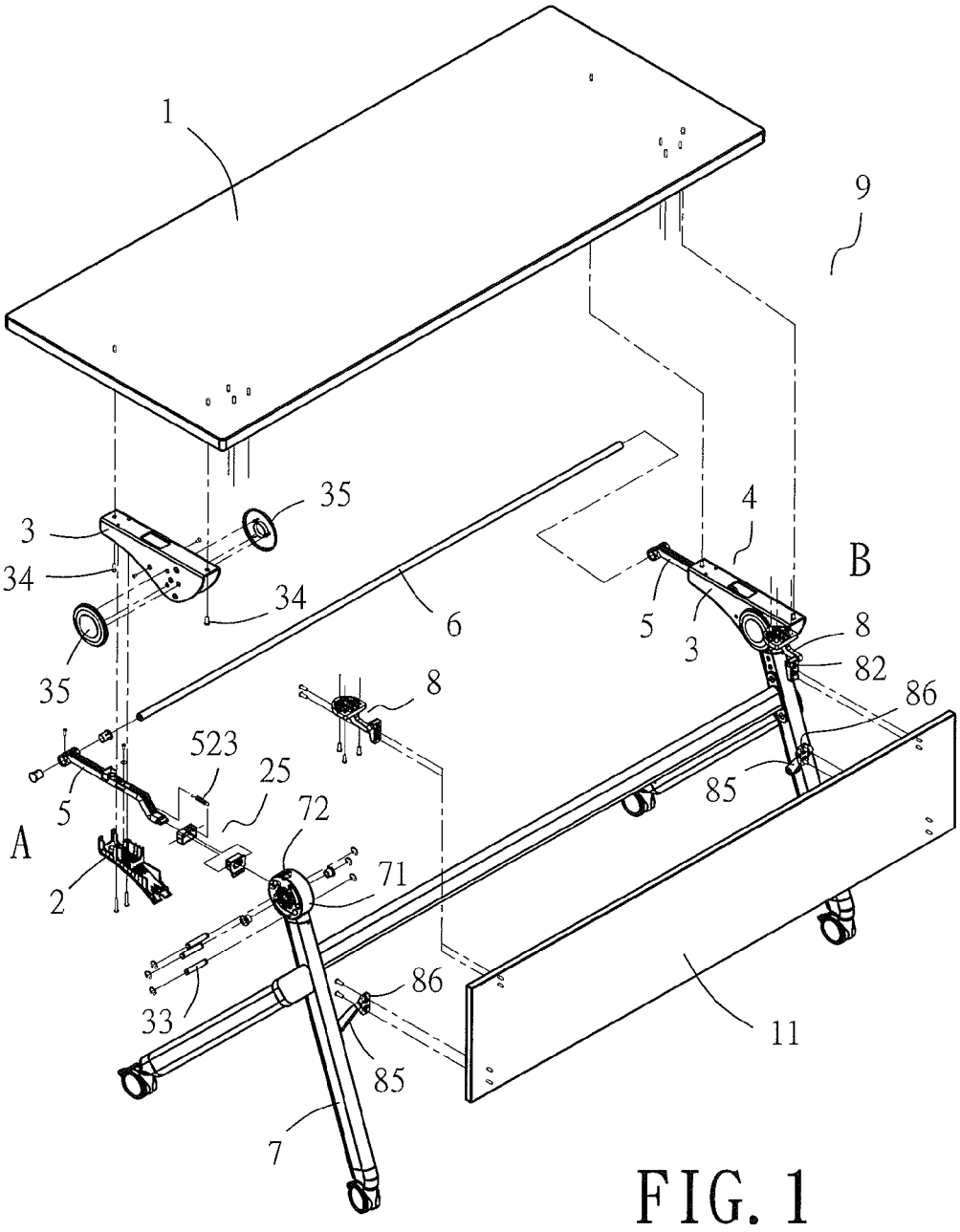
FIG. 1 is an exploded view of desk-based angle adjustment mechanism according to the present invention.

The present invention provides a desk structure with adjustable angles (shown in FIG. 1), wherein an angle-adjustment unit 9 coupled to a bottom of a desk comprises a desk board 1, left and right holding frames 4, two restricting rods 5, a grip rod 6, an inverted y-shaped desk legs 7, two auxiliary connecting elements 8, and a front guarding panel 11.

The left and right holding frames 4 are disposed on the two sides at the bottom of the desk board 1, respectively. The restricting rods 5 can be movably inserted into the left and right holding frames 4, respectively.

Figure 1A:
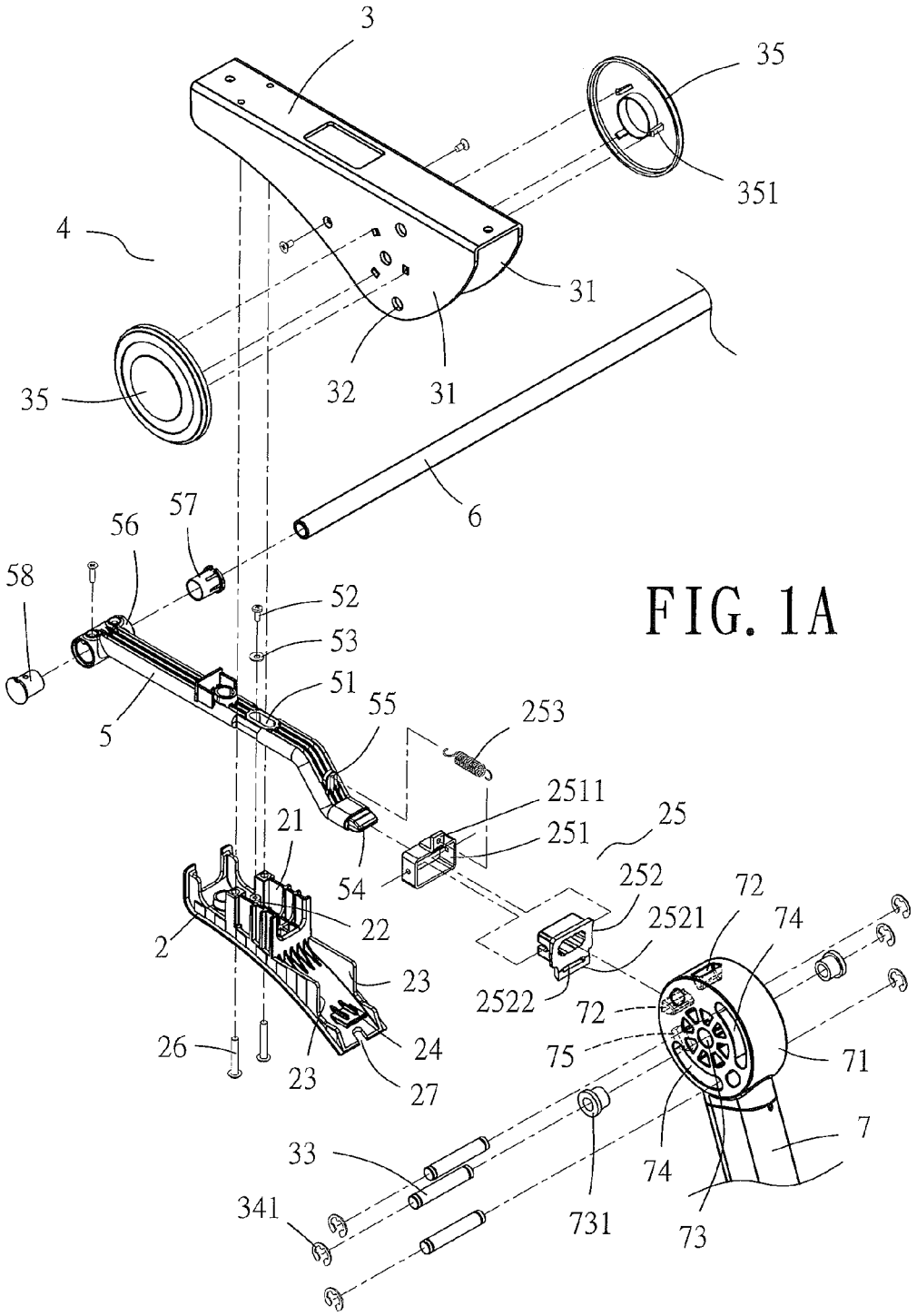
FIG. 1A is an enlarged view of portion A in FIG. 1.

The left and right holding frames 4 each comprise a carrying unit 2 below and a topping unit 3 above (shown in FIG. 1A). Frame edges 21 are formed on two sides of predetermined segments of the carrying unit 2, respectively, and a post 22 extending upward is formed between the segments, to allow the restricting rods 5 to be steadily inserted. Left and right stopping sidewalls 23 are formed on the two sides of the carrying unit 2, respectively, and a restrictive protruding portion 24 extending forward is protrudingly disposed at the middle segments of the stopping sidewalls 23, such that a buffer frame 25 for holding the front end of each of the restricting rods 5 is mounted on the carrying unit 2. Frame edges 31 extend downward from the two sides of the topping unit 3, respectively, and holes 32 are formed at predetermined positions on the frame edges 31, such that pins 33 can be passed through the holes 32 of the frame edges 31 when the inverted y-shaped desk legs 7 are inserted and disposed between the frame edges 31 of the topping unit 3.

The buffer frame 25 mounted laterally on the carrying unit 2 comprises a frame 251 and a holding portion 252. The upper end of the frame 251 extends to form a protruding portion 2511 with a hole engageable with one end of a spring 253. Another end of the spring 253 is engageable with an annular portion 55 at one end of the restricting rods 5. The holding portion 252 is of an appropriate degree of flexibility and is inserted into the frame 251. The lower end of the holding portion 252 extends to form a protruding portion 2521 with grooves 2522. The grooves 2522 admit the restrictive protruding portion 24 at a corresponding position on the carrying unit 2, such that the restricting rods 5 can be inserted steadily into the buffer frame 25 and maintain appropriate resilient displacement.

A slot 51 of a predetermined length is formed at the middle segment of the restricting rods 5 and adapted to admit the post 22 of the carrying unit 2. A screwing element 52 enclosed by a washer 53 is rotatably screwed to the post 22, such that the two restricting rods 5 can perform forward and backward displacement between the left and right holding frames 4 and within a predetermined range. Each of the restricting rods 5 has one end extending to form an abutting portion 54, and the abutting portion 54 is appropriately held by the buffer frame 25 disposed laterally at the carrying unit 2. Another end of each of the restricting rods 5 is capable of advancing and retreating movably and adjacent to the abutting portion 54, and the another end forms an annular portion 55 engageable with a spring 253, wherein another end of the spring 253 is engageable with one end of the buffer frame 25, such that the restricting rods 5 are always abutting forward. The posterior end of each of the restricting rods 5 forms a pipe 56 into which a joint ring element 57 and a cover 58 can be inserted, thereby coupling to the grip rod 6. After the restricting rods 5 have been inserted into the left and right holding frames 4 of the carrying unit 2 and the topping unit 3, the restricting rods 5 are coupled to the left and right holding frames 4 by a plurality of screwing elements 26. The left and right holding frames 4 are fixed to the two sides of the bottom of the desk board 1 by a plurality of screwing elements 34 penetrating the topping unit 3 and screwed to respective positions on the desk board 1 as shown in FIG. 1B.

One upward end of each of the inverted y-shaped desk legs 7 forms a connecting portion 71 (shown in FIG. 1A), and at least two concave portions 72 are concavely formed at predetermined segments at the periphery of the connecting portion 71, to timely admit the abutting portions 54 at the ends of the restricting rods 5. A hole 73 is disposed centrally and penetratingly at the connecting portion 71, and two curved grooves 74 corresponding in position to the holes 32, 73 are formed within a predetermined range on the connecting portion 71, such that pins 33 can penetrate the holes 32, 73 and/or the grooves 74 of the connecting portion 71 when the connecting portion 71 is inserted into the topping unit 3 (wherein two bushes 731 can be inserted into the hole 73 from the front and from behind, respectively). A C-shaped fastener 341 is disposed at each of the two ends of each said pin 33 to give a positional restriction thereto. The frame edges 31 disposed on the two sides of the topping unit 3, into which the connecting portions 71 disposed at the ends of the inverted y-shaped desk legs 7 can be inserted, are engageable with protruding portions 351 extending inward and disposed at lateral covers 35.

Figure 1B:
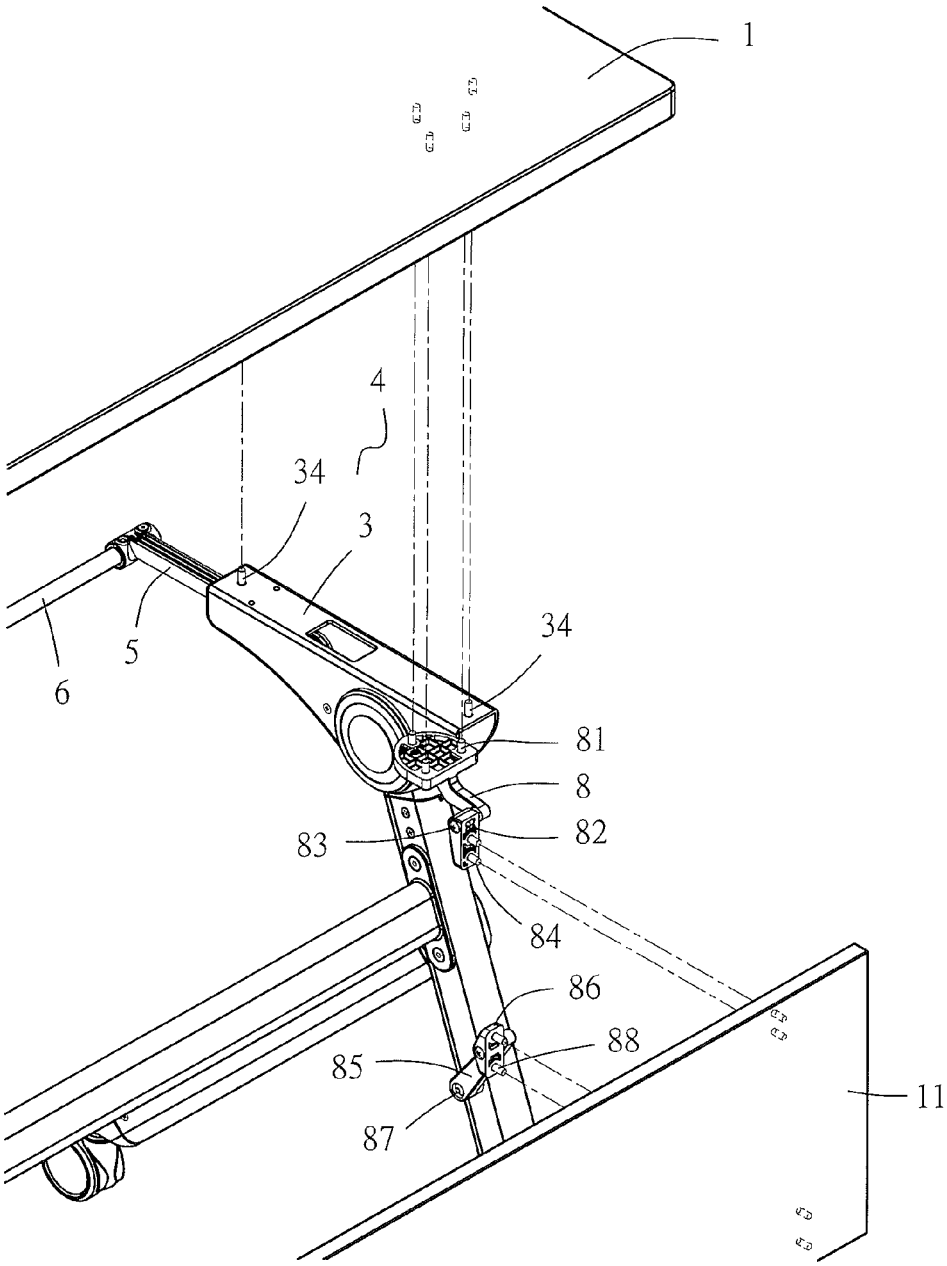
FIG. 1B is an enlarged view of portion B in FIG. 1.

The upward ends of the auxiliary connecting elements 8 abut against the bottom of the desk board 1 and are each fastened to corresponding positions on the desk board 1 by a screwing element 81 (shown in FIG. 1B). A second linking portion 82 is disposed pivotally at each of the downward ends of the auxiliary connecting elements 8 to abut against the back of the front guarding panel 11 (wherein the ends of the auxiliary connecting elements 8 and the second linking portion 82, which are disposed at the bottom of the desk board 1, are pivotally connected by a pin and/or a screwing element 83), and the auxiliary connecting elements 8 are fastened and fixed to respective positions on the front guarding panel 11 by a screwing element 84. A bar 85 is pivotally disposed at a predetermined front segment of each of the inverted y-shaped desk legs 7, and one end of the bar 85 is movably coupled to a third linking portion 86, so as to abut against a lower portion of the back of the front guarding panel 11 (wherein the bar 85 disposed at the front segment of each of the inverted y-shaped desk legs 7 and the third linking portions 86 are pivotally connected by a pin and/or a screwing element 87). The bars 85 are fastened and fixed to respective positions on the front guarding panel 11 by a screwing element 88.

Figure 10:
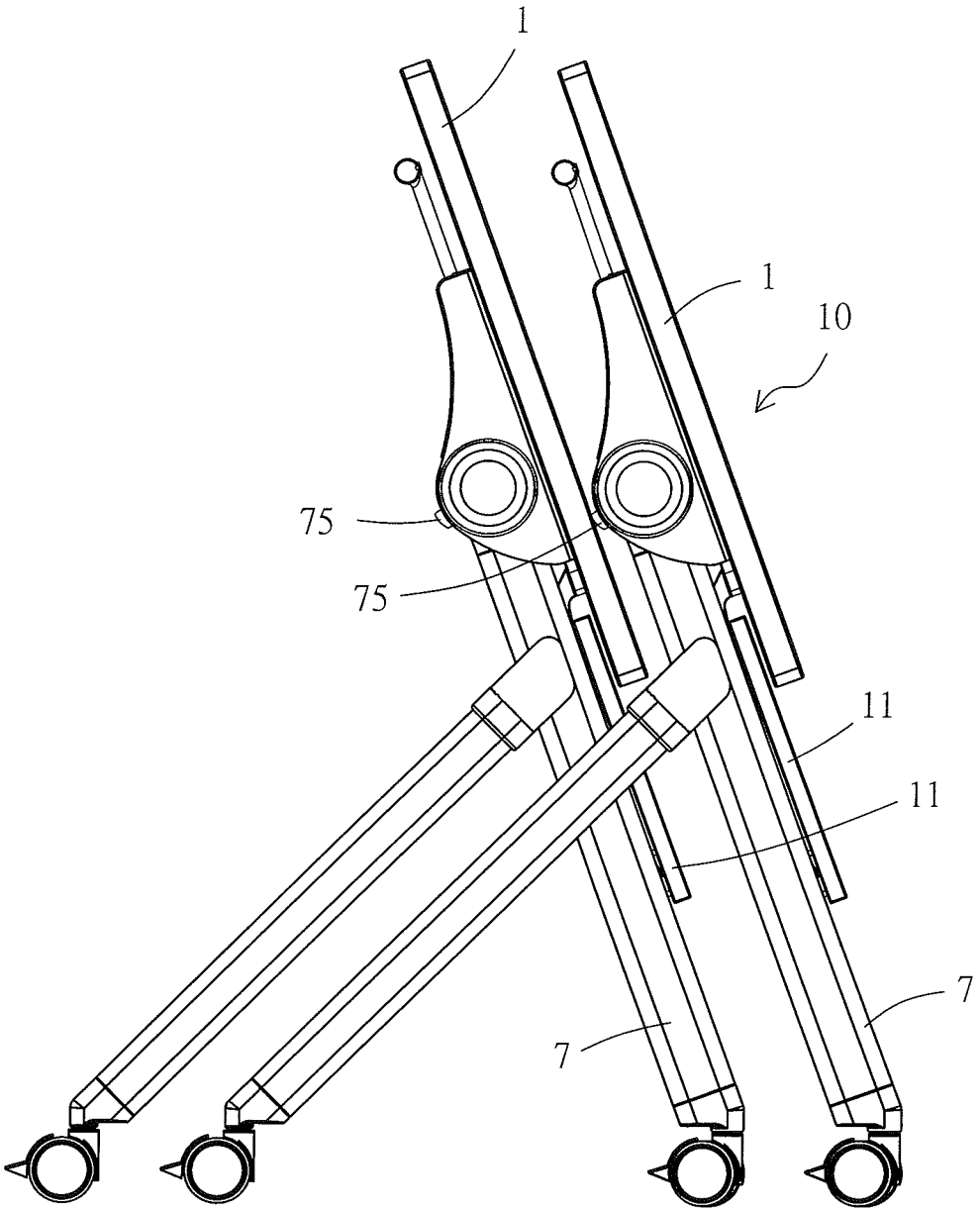
FIG. 10 is a schematic view of the desks stacked tightly according to the present invention.

A stopping block 75 (shown in FIG. 1A) of an appropriate degree of flexibility is coupled to an appropriate space between the concave portions 72 located at a rear portion of the connecting portion 71 at each of the upper ends of the inverted y-shaped desk legs 7. A notch 27 is concavely disposed on one side of the carrying unit 2 of each of the left and right holding frames 4 such that, when the desk board 1 is appropriately mounted, the carrying unit 2 straddles the stopping block 75, and the notch 27 of the carrying unit 2 passes through the stopping block 75 to undergo rotational displacement whenever the desk board 1 needs to be tilted upward and folded, thereby allowing the stacked desk boards 1 to be spaced apart from each other by an appropriate distance (shown in FIG. 10) when stacked tightly, so as to prevent the surfaces of the desk boards 1 from being scratched.

Figure 2:
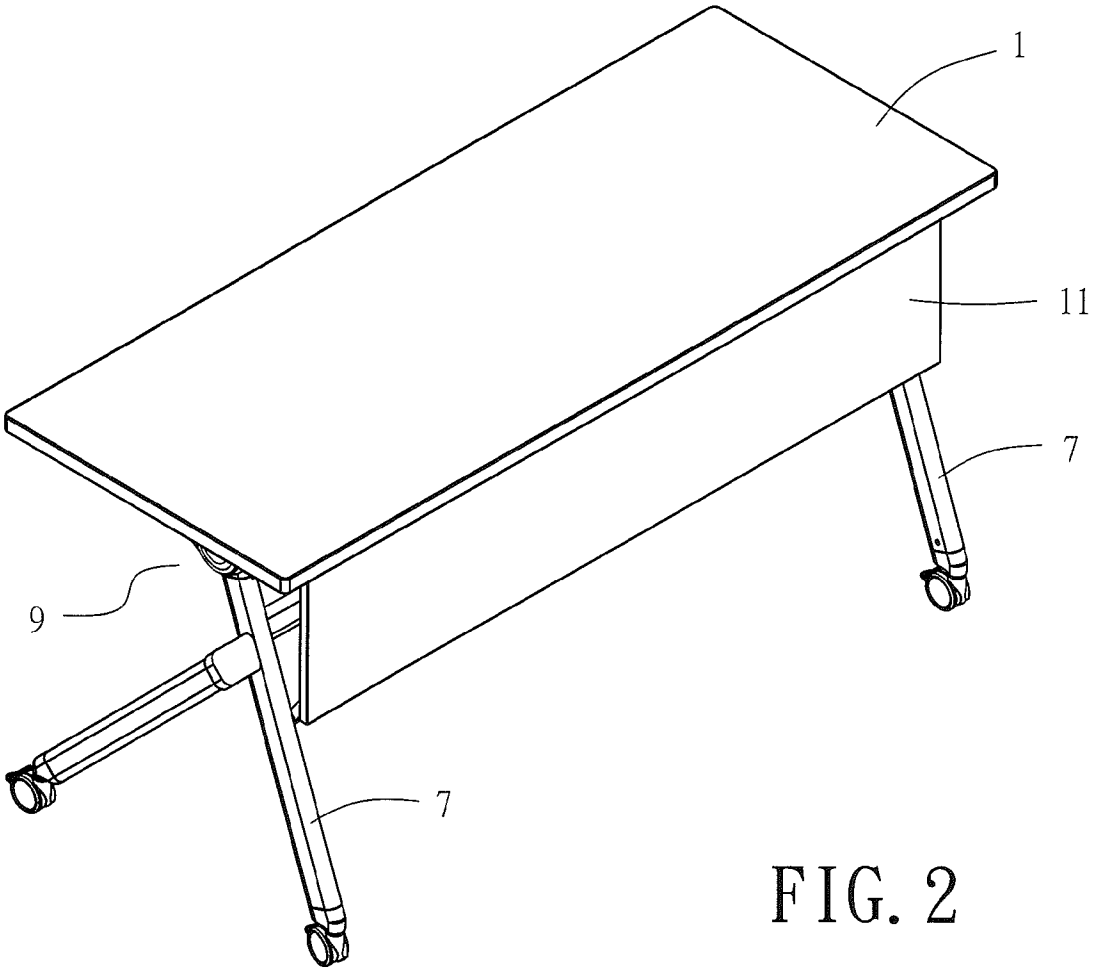
FIG. 2 is a perspective view of a desk-based angle adjustment mechanism according to the present invention.
Figure 3:
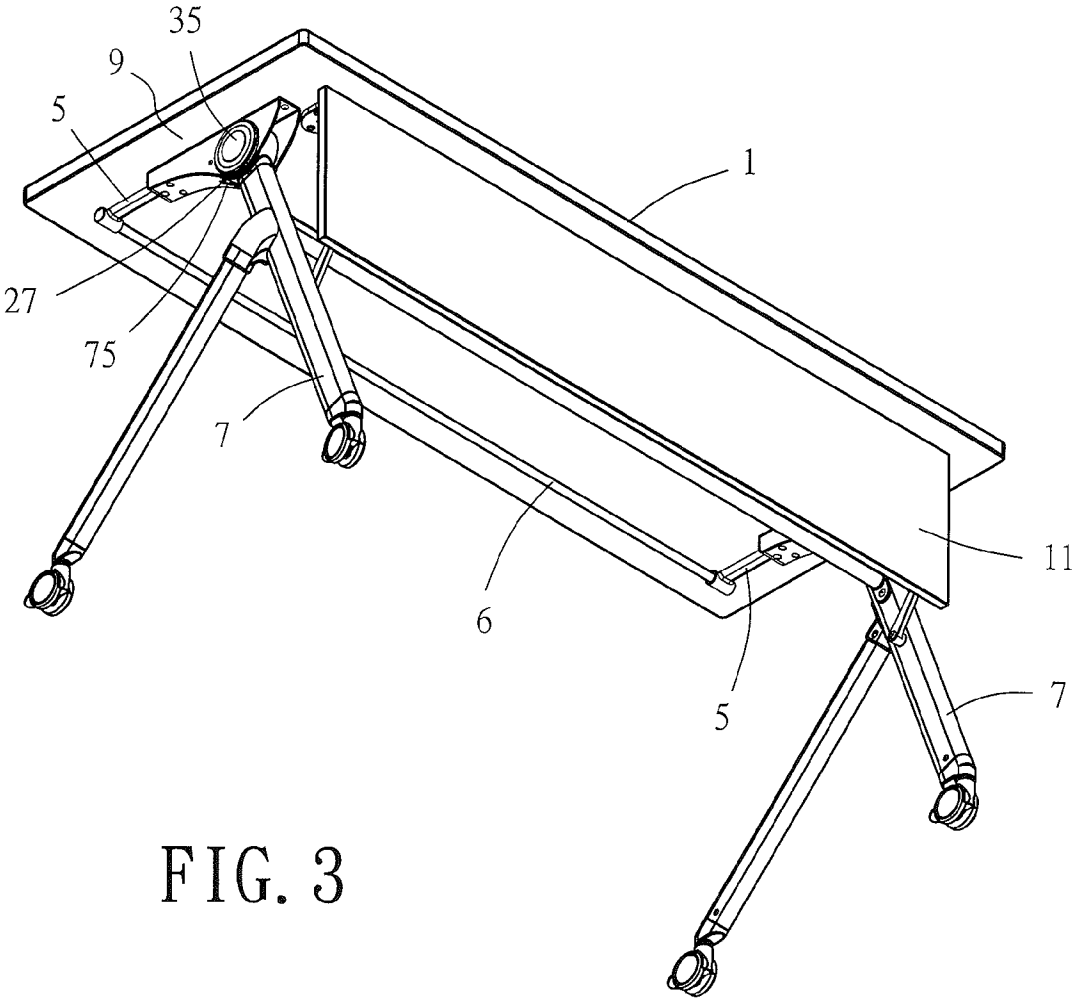
FIG. 3 is a perspective view of the desk-based angle adjustment mechanism viewed from below according to the present invention.
Figure 4:
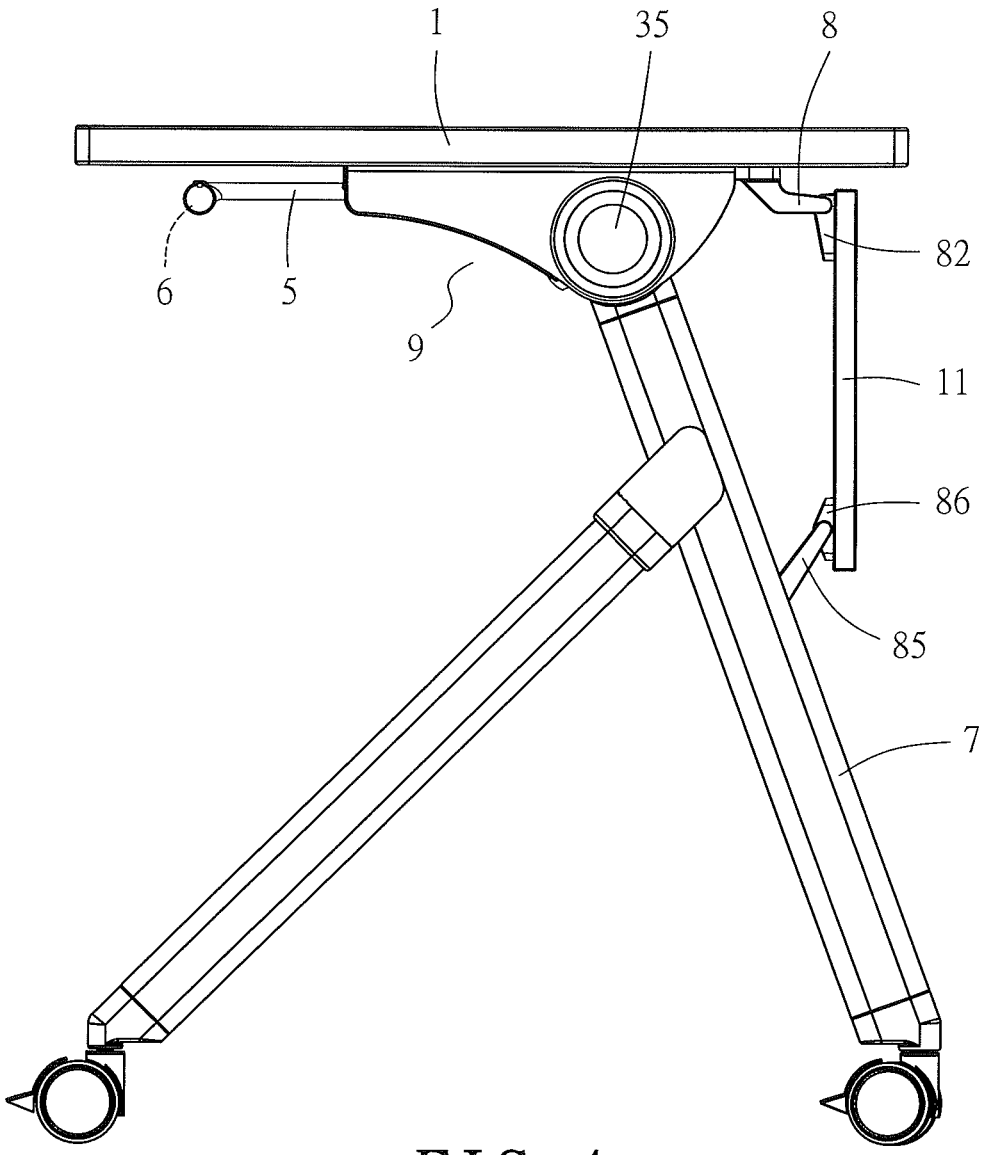
FIG. 4 is a schematic view of the desk-based angle adjustment mechanism viewed laterally according to the present invention.
Figure 5:
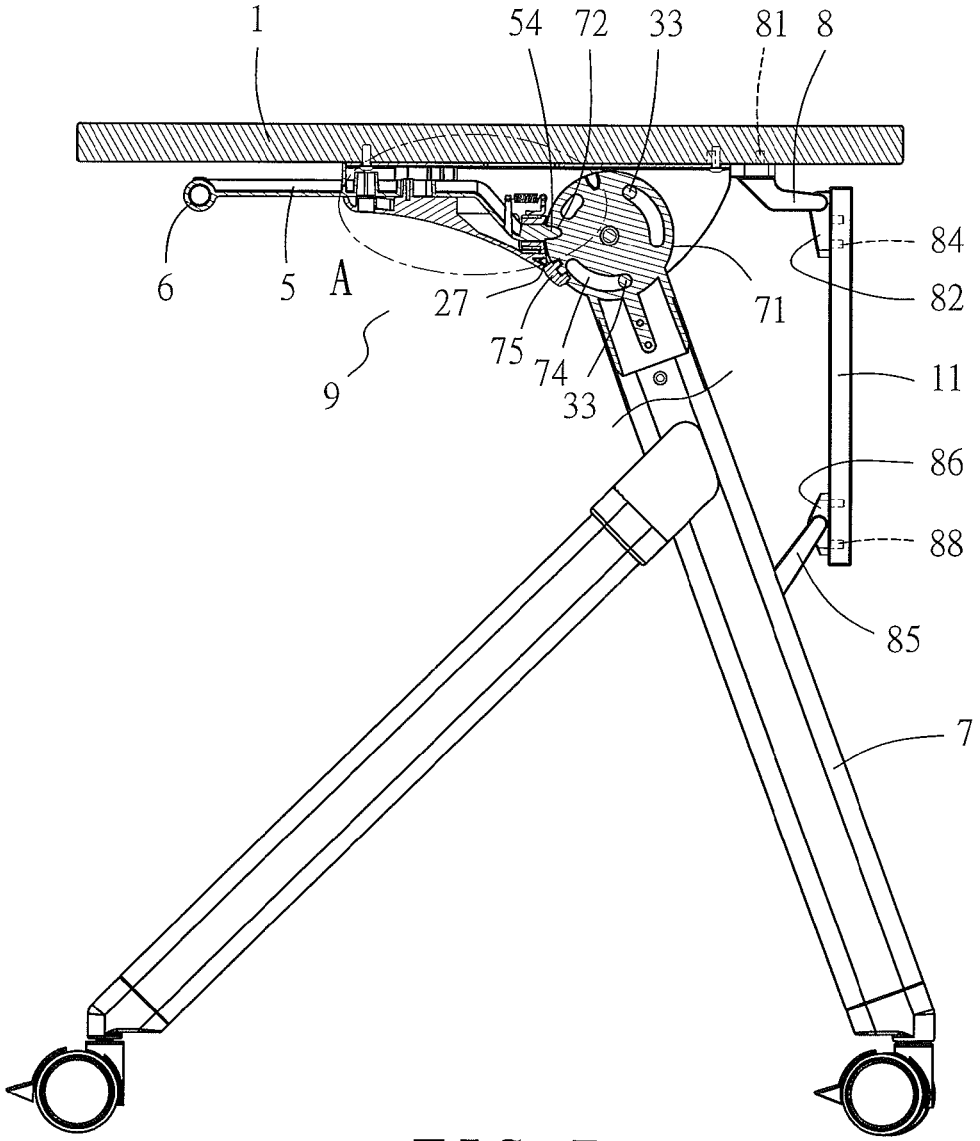
FIG. 5 is a partial cross-sectional view of the desk-based angle adjustment mechanism in a positioning state according to the present invention.
Figure 5A:
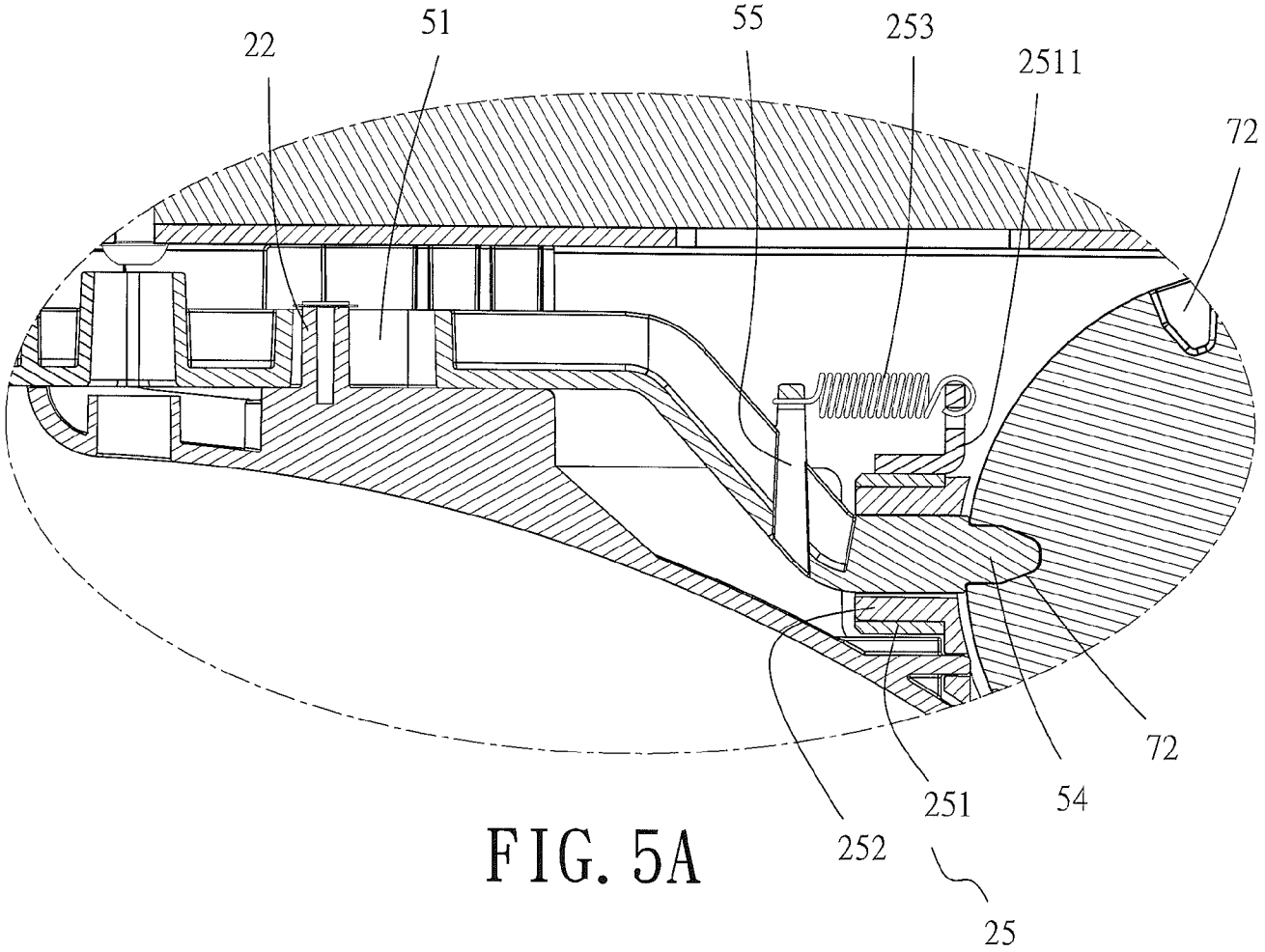
FIG. 5A is an enlarged view of portion A in FIG. 5.
Figure 6:
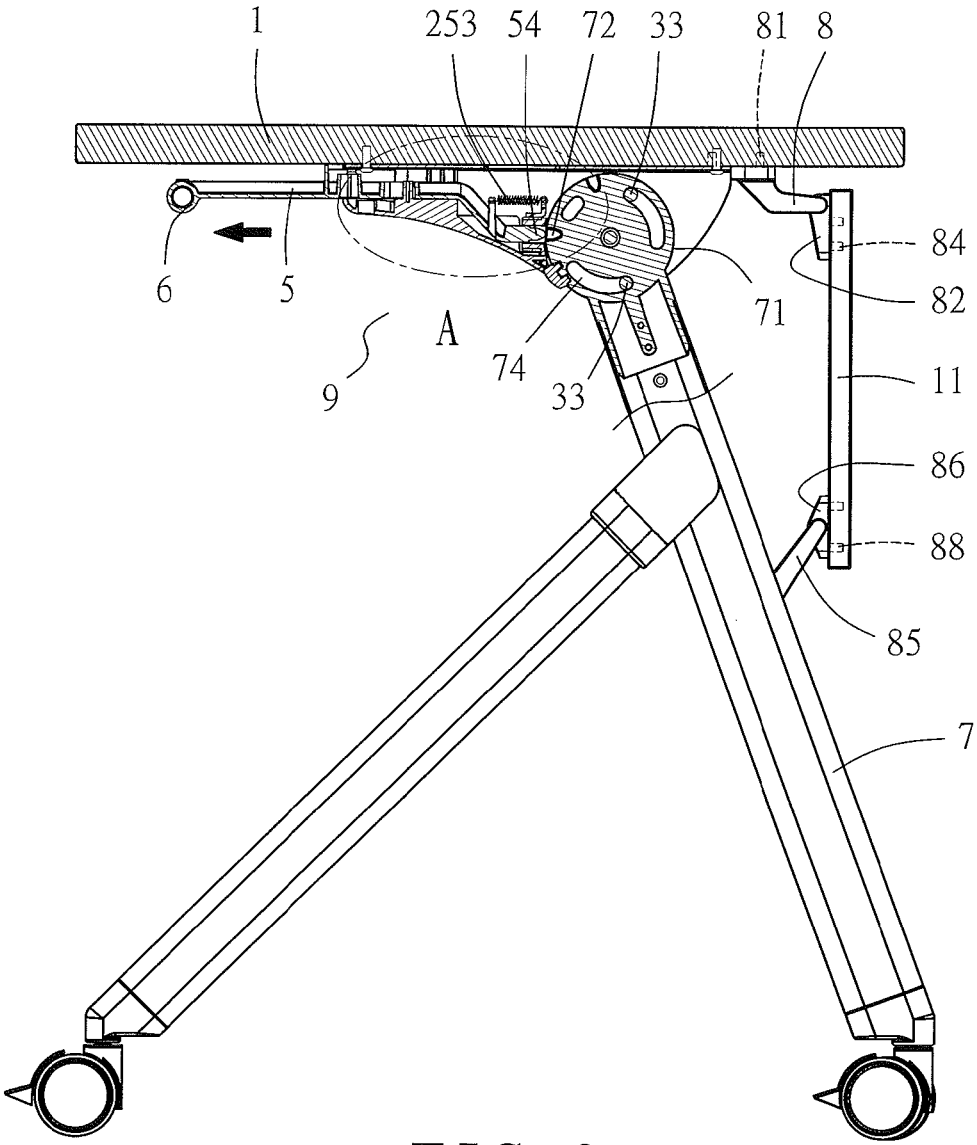
FIG. 6 is a schematic view of step 1 of the folding of the desk-based angle adjustment mechanism according to the present invention.
Figure 6A:
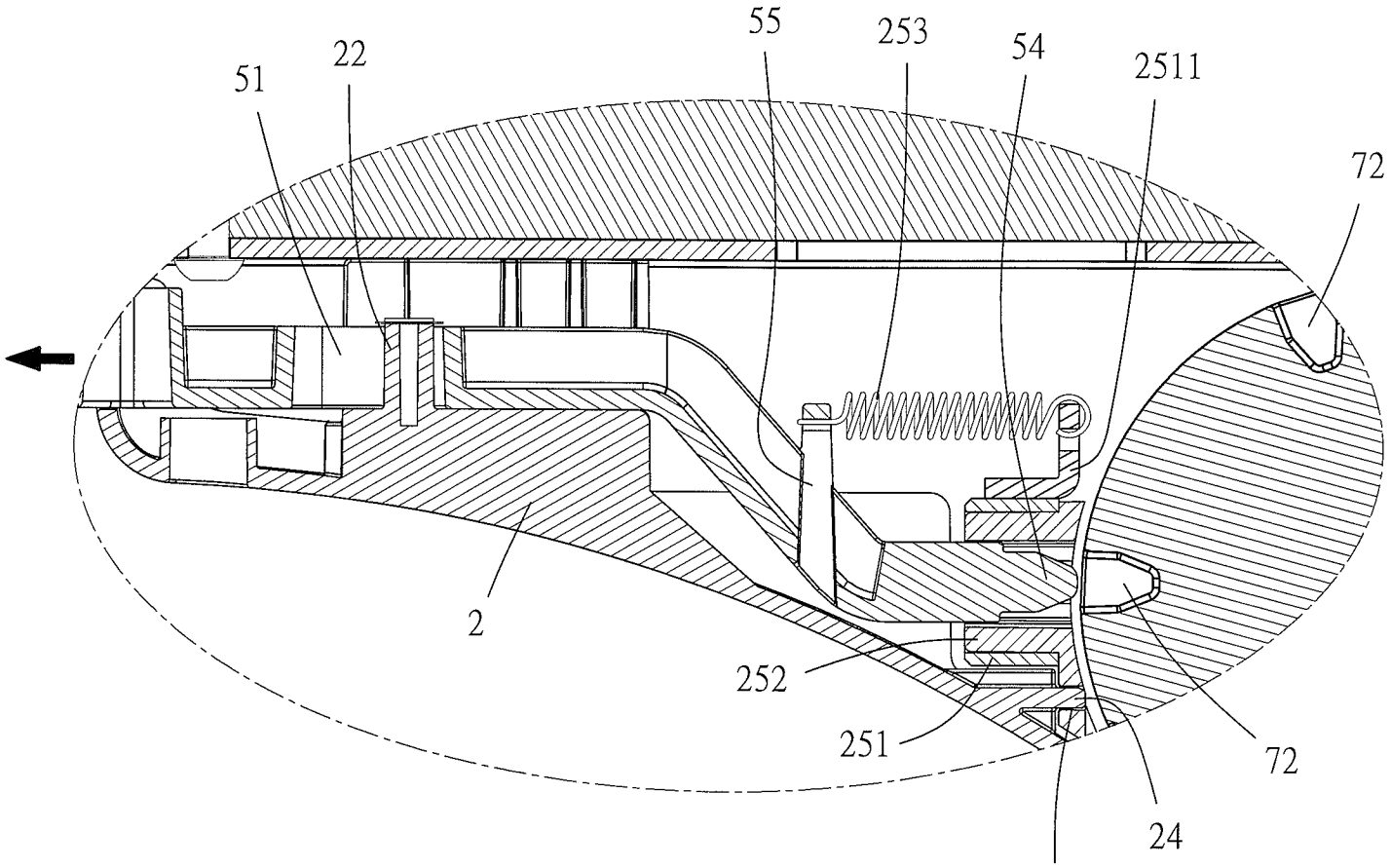
FIG. 6A is an enlarged view of portion A in FIG. 6.
Figure 7:
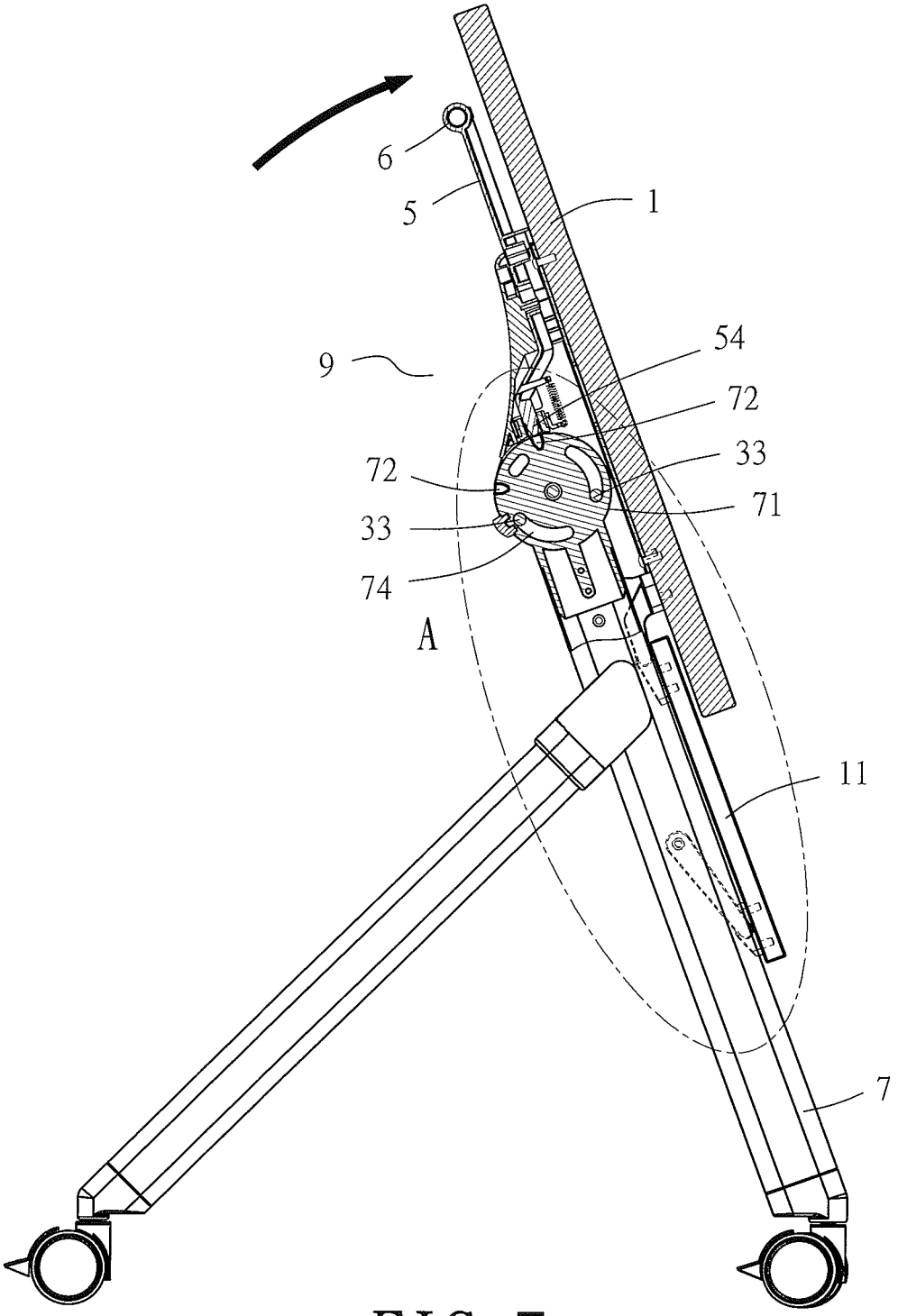
FIG. 7 is a schematic view of step 2 of the folding of the desk-based angle adjustment mechanism according to the present invention.
Figure 7A:
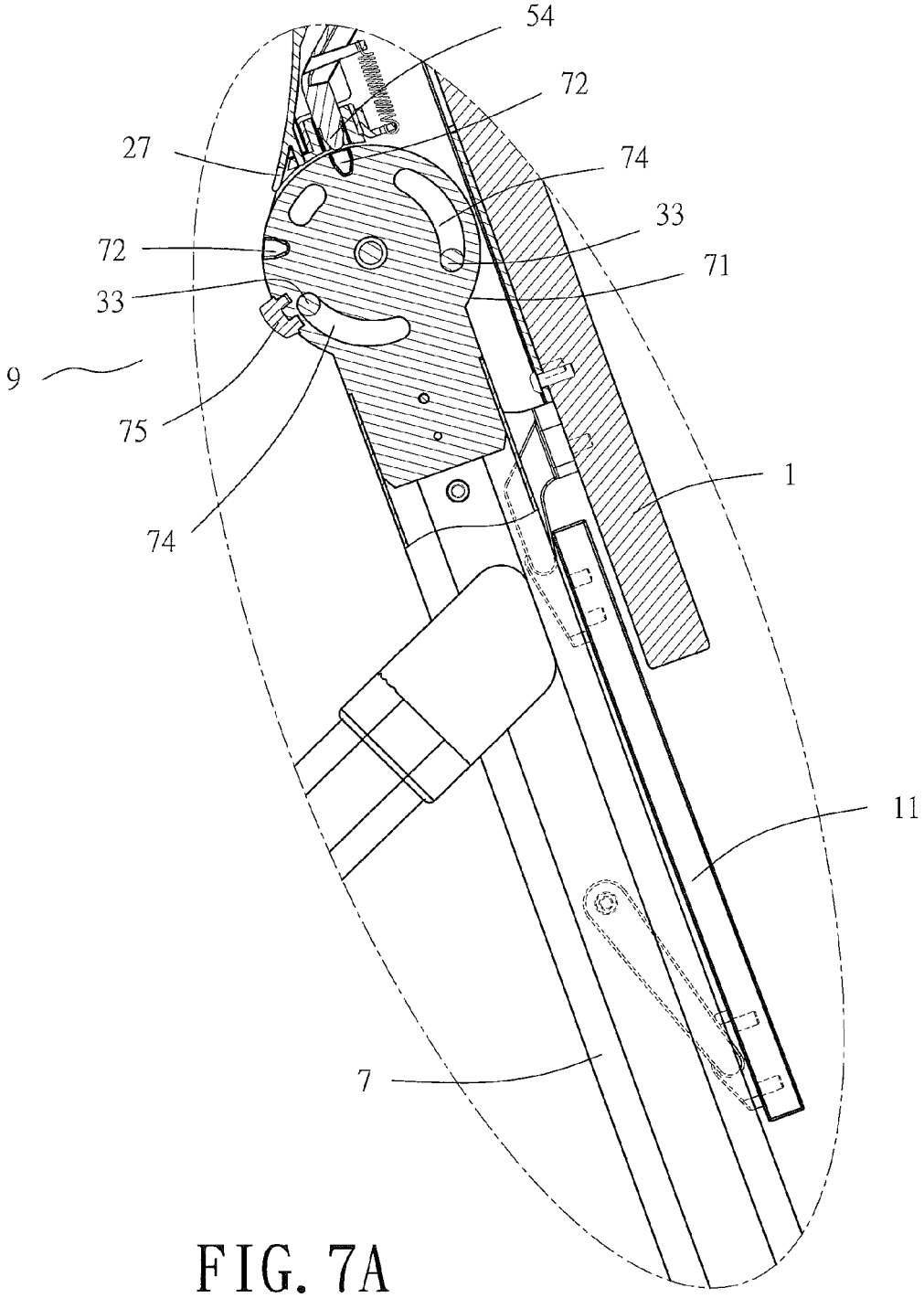
FIG. 7A is an enlarged view of portion A in FIG. 7.
Figure 8:
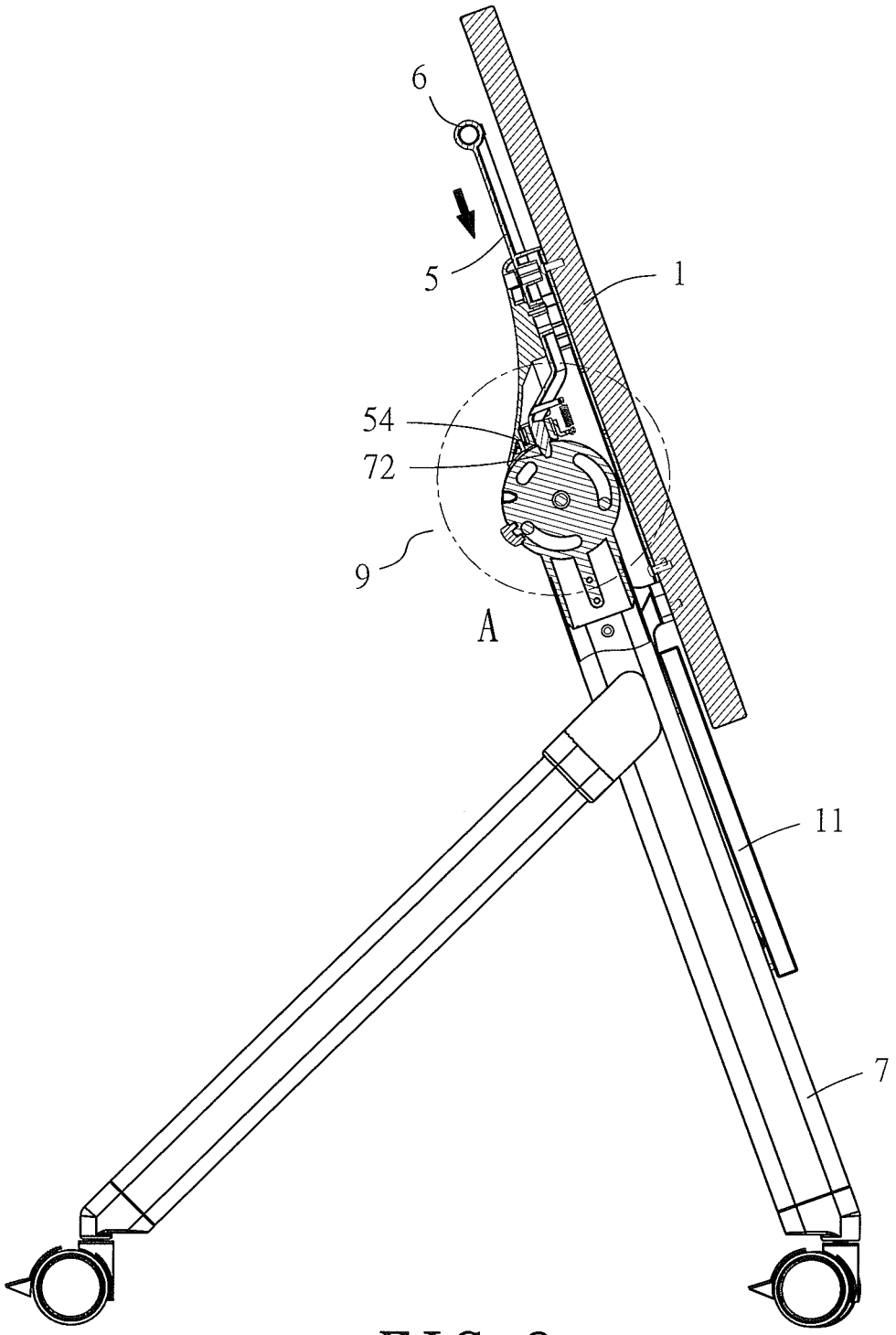
FIG. 8 is a schematic view of step 3 of the folding of the desk-based angle adjustment mechanism according to the present invention.
Figure 8A:
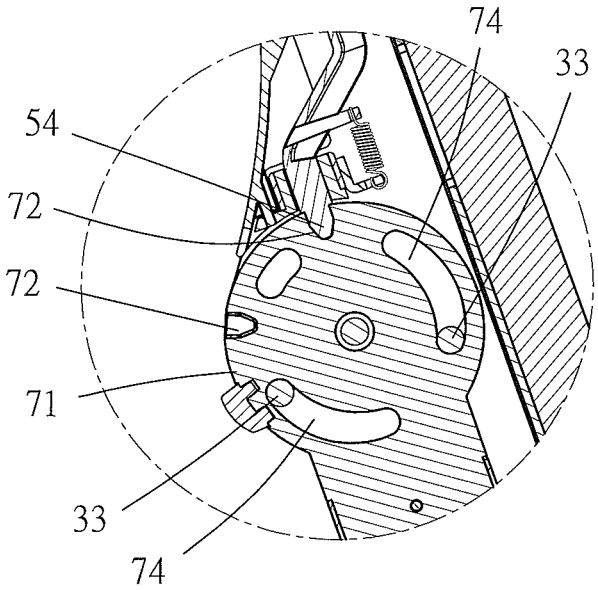
FIG. 8A is an enlarged view of portion A in FIG. 8.
Figure 9:
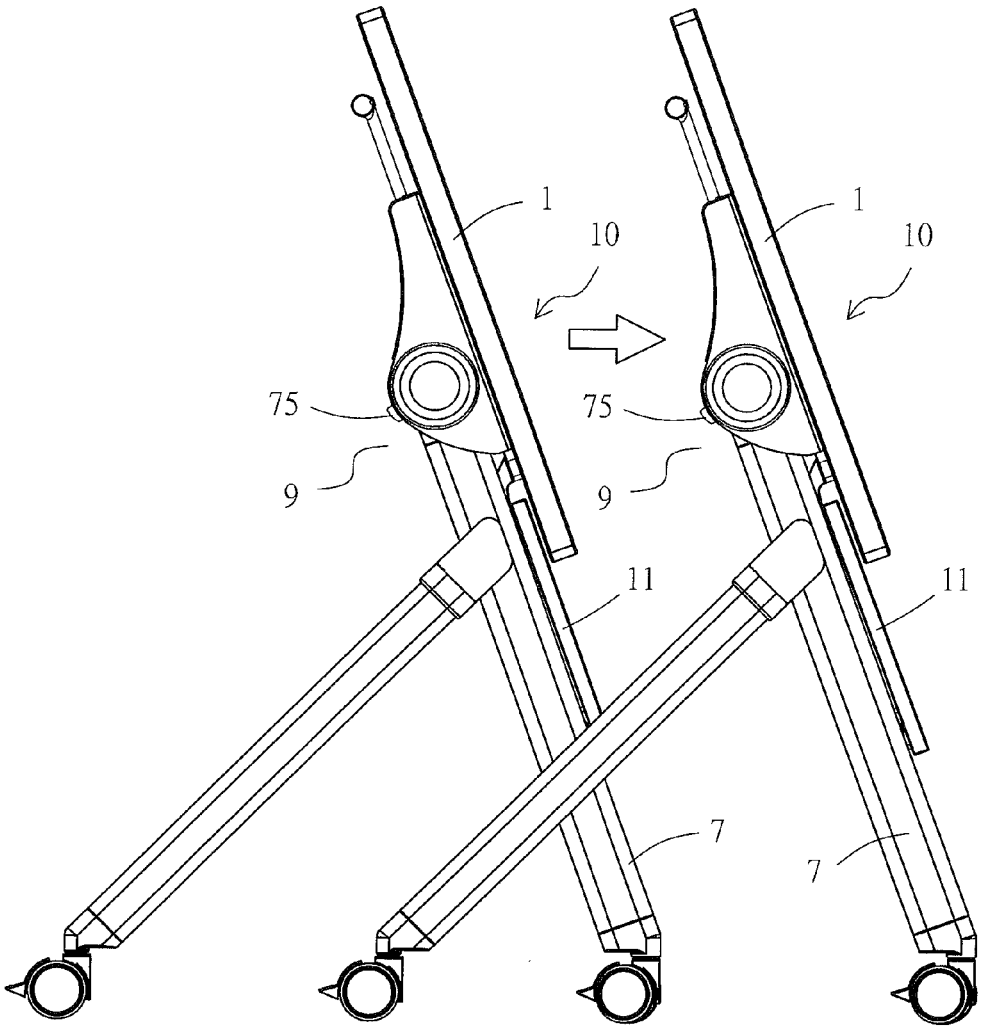
FIG. 9 is a schematic view of the desks folded and stacked by facing the same direction according to the present invention.

After the angle-adjustment unit 9 has been coupled to the desk board 1 and the front guarding panel 11 (shown in FIG. 2, FIG. 3, FIG. 4), the desk board 1 can be folded up by pulling the grip rod 6 outward by hand (shown in FIG. 5, FIG. 6) to drive the two restricting rods 5 to move outward along with the left and right holding frames 4 (wherein the displacement of the restricting rods 5 is restricted by the post 22 at one end of the carrying unit 2 of each of the left and right holding frames 4, and thus the restricting rods 5 stop moving outward and/or stop being pushed inward), and drive the abutting portions 54 at the front ends of the restricting rods 5 to separate from the concave portions 72 (shown in FIG. 5A, FIG. 6A) of the connecting portions 71 at the ends of the inverted y-shaped desk legs 7, such that the desk board 1 can move freely to rotate upward by a predetermined inclination angle (shown in FIG. 7, FIG. 7A). Then, the grip rod 6 is pushed inward to drive the two restricting rods 5 to move forward and allow the abutting portions 54 to be inserted into the concave portions 72 (shown in FIG. 8, FIG. 8A) of the connecting portion 71, respectively, such that the desk board 1 can be folded up when rotated by a predetermined inclination angle, so as to maintain precise positional restriction and allow the one and/or more desks 10 to be tilted and folded (shown in FIG. 9) and thus stacked up without taking up much space.

To unfold and start using the desk 10 whose bottom is coupled to the angle-adjustment unit 9, it is necessary to perform the aforesaid folding operation steps reversely as follows: separating the abutting portions 54 at the front ends of the restricting rods 5 from the concave portions 72 of the connecting portions 71, respectively; rotating the desk board 1 downward until the desk board 1 lies horizontally; and inserting the abutting portions 54 at the front ends of the restricting rods 5 into the concave portions 72 of the connecting portions 71, respectively, so that the desk board 1 is precisely positioned in place and thus is ready for use.

What is claimed is:

1. A desk structure with adjustable angles, wherein an angle-adjustment unit coupled to a bottom of a desk comprises a desk board, left and right holding frames, two restricting rods, a grip rod, an inverted y-shaped desk legs, two auxiliary connecting elements, and a front guarding panel, wherein the left and right holding frames are disposed on two sides at a bottom of the desk board, respectively, and the restricting rods can be movably inserted into the left and right holding frames, respectively, wherein the left and right holding frames each comprise a carrying unit below and a topping unit above, wherein frame edges are formed on two sides of predetermined segments of the carrying unit, respectively, and a post extending upward is formed between the segments, to allow the restricting rods to be steadily inserted, wherein left and right stopping sidewalls are formed on the two sides of the carrying unit, respectively, and a restrictive protruding portion extending forward is protrudingly disposed at the middle segments of the left and right stopping sidewalls, such that a buffer frame for holding the front end of each of the restricting rods is mounted on the carrying unit, wherein frame edges extend downward from the two sides of the topping unit, respectively, and holes are formed at predetermined positions on the frame edges, such that pins can be passed through the holes of the frame edges when the inverted y-shaped desk legs are inserted and disposed between the frame edges of the topping unit, wherein a slot of a predetermined length is formed at the middle segment of the restricting rods and adapted to admit the post of the carrying unit, wherein a screwing element enclosed by a washer is rotatably screwed to the post, such that the two restricting rods can perform forward and backward displacement between the left and right holding frames and within a predetermined range, wherein an anterior end of each of the restricting rods extends to form an abutting portion, and the abutting portion is appropriately held by the buffer frame disposed laterally at the carrying unit, wherein each of the restricting rods has another end capable of advancing and retreating movably and adjacent to the abutting portion, and the another end forms an annular portion engageable with a spring, wherein another end of the spring is engageable with one end of the buffer frame, such that the restricting rods are always abutting forward, wherein the posterior end of each of the restricting rods forms a pipe into which a joint ring element and a cover can be inserted, thereby coupling to the grip rod, wherein an upward end of each of the inverted y-shaped desk legs forms a connecting portion, and at least two concave portions are concavely formed at predetermined segments at the periphery of the connecting portion, to timely admit the abutting portions at the ends of the restricting rods, wherein a hole is disposed centrally and penetratingly at the connecting portion, and two curved grooves corresponding in position to the holes are formed within a predetermined range on the connecting portion, such that pins can penetrate the holes and/or the grooves of the connecting portion when the connecting portion is inserted into the topping unit, wherein a C-shaped fastener is disposed at each of the two ends of each said pin to give a positional restriction thereto, wherein upward ends of the auxiliary connecting elements abut against the bottom of the desk board and are each fastened to corresponding positions on the desk board by a screwing element, wherein a second linking portion is disposed pivotally at each of the downward ends of the auxiliary connecting elements to abut against the back of the front guarding panel, and the auxiliary connecting elements are fastened and fixed to respective positions on the front guarding panel by a screwing element, wherein a bar is pivotally disposed at a predetermined front segment of each of the inverted y-shaped desk legs, and one end of the bar is movably coupled to a third linking portion to abut against a lower portion of the back of the front guarding panel, wherein the bars are fastened and fixed to respective positions on the front guarding panel by a screwing element, wherein, after the angle-adjustment unit has been coupled to the desk board and the front guarding panel, the desk board can be folded up by pulling the grip rod outward by hand to drive the two restricting rods to move outward along with the left and right holding frames, and drive the abutting portions at the front ends of the restricting rods to separate from the concave portions of the connecting portions at the ends of the inverted y-shaped desk legs, such that the desk board can move freely to rotate upward by a predetermined inclination angle, wherein, then the grip rod is pushed inward to drive the two restricting rods to move forward and allow the abutting portions to be inserted into the concave portions of the connecting portion, respectively, such that the desk board can be folded up when rotated by a predetermined inclination angle, so as to maintain precise positional restriction and allow the one and/or more desks to be tilted and folded and thus stacked up without taking up much space.

2. The desk structure with adjustable angles of claim 1, wherein the buffer frame mounted laterally on the carrying unit comprises a frame and a holding portion, wherein the upper end of the frame extends to form a protruding portion with a hole engageable with one end of the spring, wherein another end of the spring is engageable with an annular portion at one end of each of the restricting rods, and the holding portion of is of an appropriate degree of flexibility and thus can be inserted into the frame, wherein the lower end of the holding portion extends to form a protruding portion with grooves, wherein grooves admit the restrictive protruding portion at a corresponding position on the carrying unit, such that the restricting rods can be inserted steadily into the buffer frame and maintain appropriate resilient displacement.

3. The desk structure with adjustable angles of claim 1, wherein the ends of the auxiliary connecting elements and the second linking portions disposed at the bottom of the desk board are pivotally connected by at least one of a pin and a screwing element.

4. The desk structure with adjustable angles of claim 1, wherein the bars at a front segment of the inverted y-shaped desk legs and the third linking portions are pivotally connected by at least one of a pin and a screwing element.

5. The desk structure with adjustable angles of claim 1, wherein the frame edges disposed on the two sides of the topping unit, into which the connecting portions disposed at the ends of the inverted y-shaped desk legs can be inserted, can be coupled to lateral covers.

6. The desk structure with adjustable angles of claim 1, wherein, after the restricting rods have been inserted into the left and right holding frames comprising the carrying units and the topping units, the positioning of the restricting rods relative to the left and right holding frames is achieved by a plurality of screwing elements.

7. The desk structure with adjustable angles of claim 1, wherein the left and right holding frames are fixed to the two sides of the bottom of the desk board by a plurality of screwing elements penetrating the topping unit and fixed to respective positions on the desk board.

8. The desk structure with adjustable angles of claim 1, wherein a stopping block of an appropriate degree of flexibility is coupled to an appropriate space between the concave portions located at a rear portion of the connecting portion at each of the upper ends of the inverted y-shaped desk legs, wherein a notch is concavely disposed on one side of the carrying unit of each of the left and right holding frames such that, when the desk board is appropriately mounted, the carrying unit straddles the stopping block, and the notch of the carrying unit passes through the stopping block to undergo rotational displacement whenever the desk board needs to be tilted upward and folded, thereby allowing the stacked desk boards to be spaced apart from each other by an appropriate distance when stacked tightly, so as to prevent the surfaces of the desk boards from being scratched.

* * * * *